US005196130A

United States Patent [19]

Gschwender et al.

[11] Patent Number: 5,196,130

[45] Date of Patent: Mar. 23, 1993

[54] LUBRICITY ADDITIVE FOR HIGH-TEMPERATURE GAS TURBINE ENGINE OILS

[75] Inventors: Lois J. Gschwender, Kettering; Carl E. Synder, Jr., Trotwood, both of Ohio

[73] Assignee: The United States of America as represented by the Secretary of the Air Force, Washington, D.C.

[21] Appl. No.: 805,352

[22] Filed: Dec. 9, 1991

[51] Int. Cl.[5] ..... C10M 137/04; C07F 9/14

[52] U.S. Cl. ..... 252/49.9; 558/211; 558/212

[58] Field of Search ..... 252/49.9; 558/211, 212

[56] References Cited

U.S. PATENT DOCUMENTS

| | | | |
|---|---|---|---|
| 2,866,755 | 12/1958 | Tierney | 252/49.9 |
| 3,436,441 | 4/1969 | Thompson | 252/49.9 |
| 3,483,129 | 12/1969 | Dolle, Jr. | 252/49.9 |
| 3,706,668 | 12/1972 | Clark | 252/49.9 |
| 3,855,365 | 12/1974 | Weil | 252/49.9 |
| 4,448,700 | 5/1984 | Lankamp | 252/12.4 |
| 4,849,305 | 7/1989 | Yanagisawa | 428/695 |

OTHER PUBLICATIONS

Gschwender, et al, "Synthesis and Characterization of a High Temp., Low Volatility Phosphate Additive . . . ", J. of Tribologists & Lubrication Engineers, Nov. 1991.

*Primary Examiner*—Price Willis, Jr.
*Assistant Examiner*—Thomas Steinberg
*Attorney, Agent, or Firm*—Charles E. Bricker; Donald J. Singer

[57] ABSTRACT

A tris[4-(chlorophenoxy)phenyl] phosphate of the formula:

wherein n has a value of 1 to 5. This compound is effective as a lubricity additive for high temperatures lubricants.

6 Claims, 1 Drawing Sheet

LUBRICITY ADDITIVE FOR HIGH-TEMPERATURE GAS TURBINE ENGINE OILS

RIGHTS OF THE GOVERNMENT

The invention described herein may be manufactured and used by or for the Government of the United States for all governmental purposes without the payment of any royalty.

BACKGROUND OF THE INVENTION

This invention relates to additives for polyphenylether lubricants.

Tricresyl phosphate (TCP) is a widely used and effective antiwear additive for a variety of lubricants used in aerospace applications. However, for high-temperature gas turbine engine oil (GTO) applications, volatility and thermo-oxidative stability limitations preclude the use of TCP.

Gas turbine engine oil requirements for the next generation military engines are for high-temperature, i.e., 315° to 370° C., lubricants. One group of materials which satisfies this requirement is the aromatic ethers, i.e., $C_6H_5—O—(—C_6H_4—O—)_n—C_6H_5$, where n is 2 to 4, or greater. For example, the base stock for MIL-L-87100, a 300° C. GTO, is currently m-bis-(m-phenoxyphenyl) benzene. Other suitable base fluids are the thioaromatic ethers, cyclic phosphazines, and the like.

Efforts are underway to increase the upper use temperature of GTO lubricants either by modifying their chemical structure or by developing antioxidants capable of increasing the upper use temperature. Together with the need for higher temperature antioxidants, there is a need for an antiwear additive which is stable and effective at the higher temperature.

TCP has been found to be a good lubricity additive for the above-described base stock at 75° C. with 52-100 steel and at 204° C. with M50 steel. TCP is not, however, suitable for use at 315° C. because its upper use temperature is about 290° C.

Accordingly, it is an object of the present invention to provide a lubricity additive for GTO lubricants which is stable and effective at higher temperatures.

Other objects and advantages of the invention will be apparent to those skilled in the art.

SUMMARY OF THE INVENTION

Figure 1:
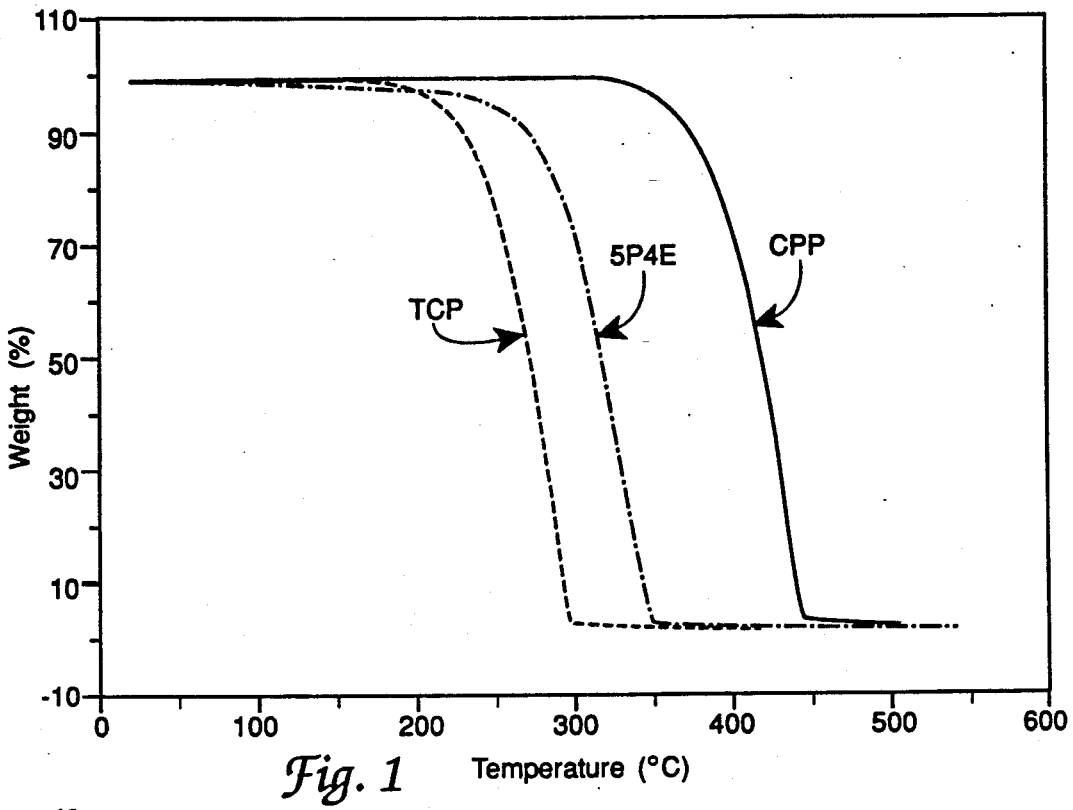
FIG. 1 is a graphic representation of the thermal gravimetric analysis of tricresyl phosphate (TCP), m-bis-(m-phenoxyphenyl) benzene (5P4E) and tris(4-(4'-chlorophenoxy)phenyl)phosphate (CPP)

In accordance with the present invention, there is provided a novel lubricity additive for GTO lubricants which is stable and effective at higher temperatures. This novel lubricity additive is a tris(4-(chlorophenoxy)phenyl)phosphate of the formula:

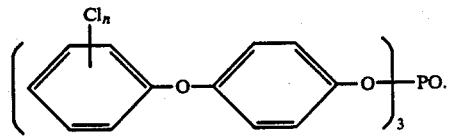

wherein n has a value of 1 to 5.

The tris(4-(chlorophenoxy)phenyl)phosphate may be prepared as shown by the following reaction sequence:

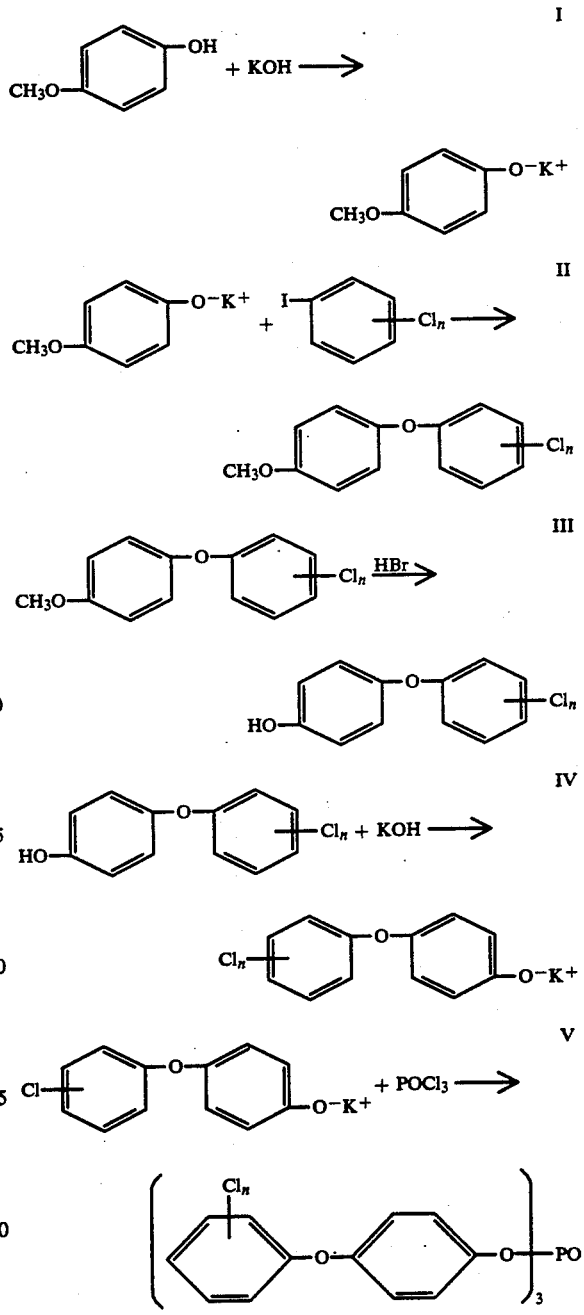

The tris(4-(chlorophenoxy)phenyl)phosphate is added to a high-temperature gas turbine engine lubricant in an amount ranging from about 0.1 to 7.0 weight percent, preferably about 0.5 to 5.0 wt. %. This invention also contemplates the use of other additives in combination with the above-described phosphates. Such additives include, for example, auxiliary detergents and dispersants of the ash-producing or ashless type, corrosion- and oxidation-inhibiting agents, pour point depressing agents, extreme pressure agents, color stabilizers and anti-foam agents.

The following example illustrates the invention:

EXAMPLE

Preparation of tris(4-(4'-chlorophenoxy)phenyl)phosphate

A mixture of 24.8 g. of 4-methoxyphenol and 13.2 g 85% KOH in 350 ml xylene was refluxed for 2.5 hours in a Dean-Stark apparatus. 47.7 g 1-chloro-4-iodobenzene, 2.0 g Cu and 2.0 g cuprous chloride were added, under nitrogen, to the thus-formed potassium phenate. The resulting mixture was heated to reflux and the xylene was distilled off at 140°-200° C. The residue was distilled under reduced pressure to collect 4-(4'-chlorophenoxy)anisole, b.p. 135° C./0.07 mm. Yield 30 g (64%).

The 4-(4'-chlorophenoxy)anisol was demethylated by refluxing it with an excess of 48% HBr in glacial acetic acid for 24 hours. The crude product, obtained after hydrolysis and extraction with diethyl ether, was recrystallized from hexane to yield 4-(4'-chlorophenoxy)-phenol as a white solid, bp 83°-85° C., 24.5 g (91.4%).

A mixture of 23.7 g of 4-(4'-chlorophenoxy)phenol and 7.08 g of 85% KOH in 150 ml of toluene was refluxed for 2 hours in a Dean-Stark apparatus. To the thus-formed potassium salt in toluene was added 5.5 g $POCl_3$ dropwise, while maintaining the reaction temperature at about 5° C. After the addition, the contents were allowed to warm to ambient temperature. The reaction mixture was washed with 10% KOH, then with water, and then dried. Removal of the toluene gave the phosphate as a light brown oil. The crude product was purified using a mixture of diethyl ether and hexane. Pure tris(4-(4'-chlorophenoxy)phenyl)-phosphate was a white solid, mp 61° C., yield 20 g (83%). Analytical and spectral data agreed with data expected for this compound.

Lubricity

Tris(4-(4'-chlorophenoxy)phenyl)phosphate (CCP) and tricresyl phosphate (TCP) were formulated into m-bis-(m-phenoxyphenyl) benzene (5P4E) in the amounts (wt. %) shown in Table I, below, which shows lubricity data as determined by four ball wear testing (ASTM D2266 0.5 inch balls, 52-100 steel, 2 hr., 40 kg, 600 rpm). Four ball wear test data for MIL-L-87100 GTO is included for comparison.

TABLE I

| Fluid | Additive | Concentration | Wear Scar, mm |
|---|---|---|---|
| MIL-L-87100 | (none) | — | 1.26 |
| 5P4E | (none) | — | 1.17 |
| 5P4E | TCP | 1.0 | 0.71 |
| 5P4E | TCP | 3.0 | 0.74 |
| 5P4E | TCP | 5.0 | 0.68 |
| 5P4E | CPP | 1.0 | 0.82 |
| 5P4E | CPP | 3.0 | 0.69 |

TABLE I-continued

| Fluid | Additive | Concentration | Wear Scar, mm |
|---|---|---|---|
| 5P4E | CPP | 5.0 | 0.77 |

The lack of a lubricity additive in MIL-L-87100 is apparent because the wear scar data for this lubricant and the base stock are within repeatability of the method. The TCP and CPP additives effectively reduced the wear scars, as compared to unformulated fluid, by about the same amount. These data illustrate that CPP is at least as effective a lubricity additive as TCP.

Volatility

The results of thermal gravimetric analysis of TCP, 5P4E and CPP are shown in FIG. 1. Conditions: sample size ≈ 10 mg., $N_2$, 10° C./min. With reference to FIG. 1, it can be seen that $T_{\frac{1}{2}}$, the temperature at which half of the sample had evaporated, was 426° C. for CPP and 279° C. for TCP, a significant difference of 147° C. The $T_{\frac{1}{2}}$ of CPP is well above the $T_{\frac{1}{2}}$ of the base oil 5P4E.

Oxidative Stability

Figure 2:
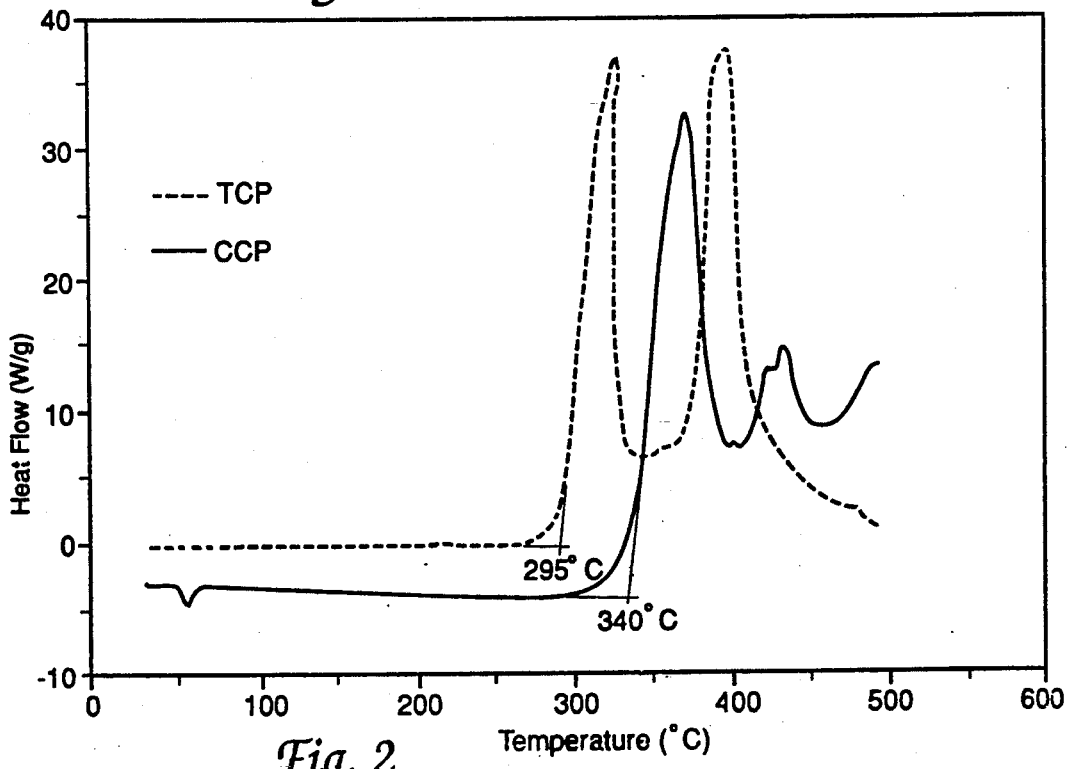
FIG. 2 is a graphic representation of pressure differential scanning calorimetry scans of TCP and CPP.

The results of pressure differential scanning calorimetry of TCP and CPP are shown in FIG. 2. Conditions: sample size 5 mg., $O_2$, 3.45 MPa, 10° C./min. With reference to FIG. 2, it can be seen that the oxidation onset temperature for CPP was 340° C., while for TCP, it was 296° C.

The above data illustrate that CCP is an effective lubricity additive for high temperature 5P4E gas turbine engine oil, that CPP has the required low volatility and thermo-oxidative stability for high temperature use.

Various modifications may be made to the invention as described without departing from the spirit of the invention or the scope of the appended claims.

We claim:

1. A high-temperature gas turbine engine oil comprising a high-temperature base stock and 0.1 to 7.0 weight percent of a tris(4-(chlorophenoxy)phenyl)phosphate of the formula

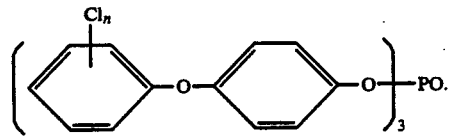

wherein n has a value of 1 to 5.

2. The engine oil of claim 1 wherein n has a value of 1.

3. The engine oil of claim 2 wherein Cl is in the para position.

4. A tris(4-(chlorophenoxy)phenyl)phosphate of the formula:

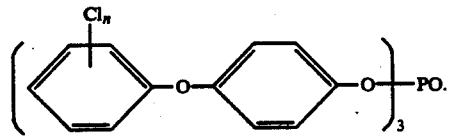

wherein n has a value of 1 to 5.

5. The compound of claim 4 wherein n is 1.

6. The compound of claim 5 wherein Cl is in the para position.

* * * * *

UNITED STATES PATENT AND TRADEMARK OFFICE

CERTIFICATE OF CORRECTION

PATENT NO. : 5,196,130

DATED : March 23, 1993

INVENTOR(S) : Lois J. Gschwender et al

It is certified that error appears in the above-identified patent and that said Letters Patent is hereby corrected as shown below:

On title page, item [75] "Carl E. Synder, Jr." should read --Carl E. Snyder, Jr.--

Column 3, line 50, "(CCP)" should read -- (CPP) --.

Column 4, line 29, "CCP" should read -- CPP --.

Signed and Sealed this

Eighth Day of February, 1994

Bruce Lehman

*Attest:*

BRUCE LEHMAN

*Attesting Officer*

*Commissioner of Patents and Trademarks*